United States Patent [19]

Ludwig

[11] Patent Number: 4,999,212

[45] Date of Patent: Mar. 12, 1991

[54] PROCESS AND APPARATUS FOR APPLYING A FLOWABLE SUBSTANCE TO A SUBSTRATE

[76] Inventor: Volker Ludwig, Untere Muhlewiesen 10, D-7896 Wutoschingen-Degernau, Fed. Rep. of Germany

[21] Appl. No.: 386,900

[22] Filed: Jul. 28, 1989

[30] Foreign Application Priority Data

Aug. 3, 1988 [DE] Fed. Rep. of Germany ..... 3826395

[51] Int. Cl.[5] ..... B05D 1/26

[52] U.S. Cl. ..... 427/8; 427/282; 118/668; 118/410; 118/411

[58] Field of Search ..... 427/8, 282; 118/245, 118/246, 665, 688, 712, 410, 411, 259, 266

[56] References Cited

U.S. PATENT DOCUMENTS

| | | | |
|---|---|---|---|
| 3,638,459 | 2/1972 | Zimmer | 118/324 X |
| 4,220,114 | 9/1980 | Radowicz | 118/411 |
| 4,671,205 | 6/1987 | Bulleter | 118/323 X |

*Primary Examiner*—Shrive Beck
*Assistant Examiner*—Alain Bashore
*Attorney, Agent, or Firm*—Bachman & LaPointe

[57] ABSTRACT

Apparatus and process for applying a flowable substance to a substrate. A perforated cylinder feeds the flowable substance to the substrate with a counter-pressure roll adjacent. A lift-off roll assists in drawing the substrate off the cylinder in response to the degree of adhesion between substrate and cylinder. The distance between the axes of rotation of the counter-pressure roll and cylinder is less than the sum of radii of the roll and cylinder.

11 Claims, 1 Drawing Sheet

PROCESS AND APPARATUS FOR APPLYING A FLOWABLE SUBSTANCE TO A SUBSTRATE

BACKGROUND OF THE INVENTION

The invention relates to a process for the application of liquid, pasty or plastic substances, in particular of thermoplastics, to a substrate, the substance being melted, heated and applied to the substrate through a perforated cylinder, it adhering to the said substrate over a certain distance before it is drawn off, as well as an apparatus for this.

German Offenlegungsschrift 3,638,307 discloses such a process and such an apparatus, the nozzle mouth being followed inside the metal cylinder by an air nozzle, which forms a nozzle gap bounded by lips towards the metal cylinder. Furthermore, outside the metal cylinder there are arranged cooling and heating sections, before the substrate runs through a pair of calendar rolls. In this case it has been found in practice that, at different temperatures of the coating substance, a different tension has to be exerted on the substrate in order to lift the substrate off the perforated metal cylinder.

The object of the present invention is to improve substantially the temperature control for the coating substance and, furthermore, also to ensure an improvement in the application of the coating substance as well as in the handling of the coating head when the apparatus is switched off.

SUMMARY OF THE INVENTION

Leading to the achievement of this object is a process of the abovementioned type in which the adhesion of the substrate on the cylinder is determined and used as a control signal for controlling the heating of the substance. The adhesion is determined directly or indirectly, for example via the length of the adhering section and/or the drawing-off force and/or the drawing-off angle between cylinder and substrate, the tension of the substrate being kept constant.

It has been found in practice that a colder coating substance adheres for longer and more intensively on the cylinder before the substrate can be drawn off over the roll. This means that a certain pressure is exerted on the roll, which is increased with a colder coating substance.

In an illustrative embodiment, this pressure, or the drawing-off force, can now be measured directly. If the drawing-off force to be applied increases, the heating elements are to be activated via a corresponding control device and the heat emission increased.

In a preferred illustrative embodiment of the invention, however, the roll changes its position on the cylinder according to the adhesion of the substance. If a corresponding range of the change in position is exceeded, here too a control unit is to be activated, which controls the heating elements until the roll again returns to its initial position. The return is performed preferably by a counter force which is exerted on the roll, for example by an appropriate helical spring.

Furthermore, it is provided according to the invention to irradiate the region of lifting-off of the substrate from the cylinder with an infrared heat source. Infrared radiation has the advantage that the heat is absorbed by the substrate or the cylinder without a heating up of the region between source and cylinder occurring. This also brings about an improvement in the lifting-off of the substrate from the cylinder.

Furthermore, it is within the scope of the invention that the distance between the axes of rotation of counter-pressure roll and cylinder is smaller than the sum of the radii, that furthermore the counter-pressure roll consists of a flexible material and that a contact surface of the coating head has, for the formation of the coating gap, a curvature of which the radius corresponds approximately to that of the cylinder.

As a result, in a preferred embodiment, a planar coating gap is formed, so that sealing lips are not required. Furthermore, the planar pressure also improves the wetting of the substrate by means of the substance.

It serves to improve the use of the coating head when the apparatus is switched off that a vacuum pump is inserted into the supply line for the substance. This vacuum pump is preferably connected to the coating head via a three-way valve and then set in operation whenever the apparatus is switched off. As a result, the coating head is emptied and there is no dripping of the substance.

In further preferred embodiment of the invention, the coating head consists of part-segments, which are connected to one another. The connection can be made, for example, via corresponding tie rods. This has the effect of determining or changing the width of the coating head and also makes a stripwise coating possible, by one or more part-segments having no outlet gap for a coating substance. Furthermore, a supply of different coating substance to individual part-segments is also possible.

BRIEF DESCRIPTION OF THE DRAWINGS

Further advantages, features and details of the invention emerge from the following description of preferred illustrative embodiments and with reference to the drawings, in which.

DETAILED DESCRIPTION

Figure 1:
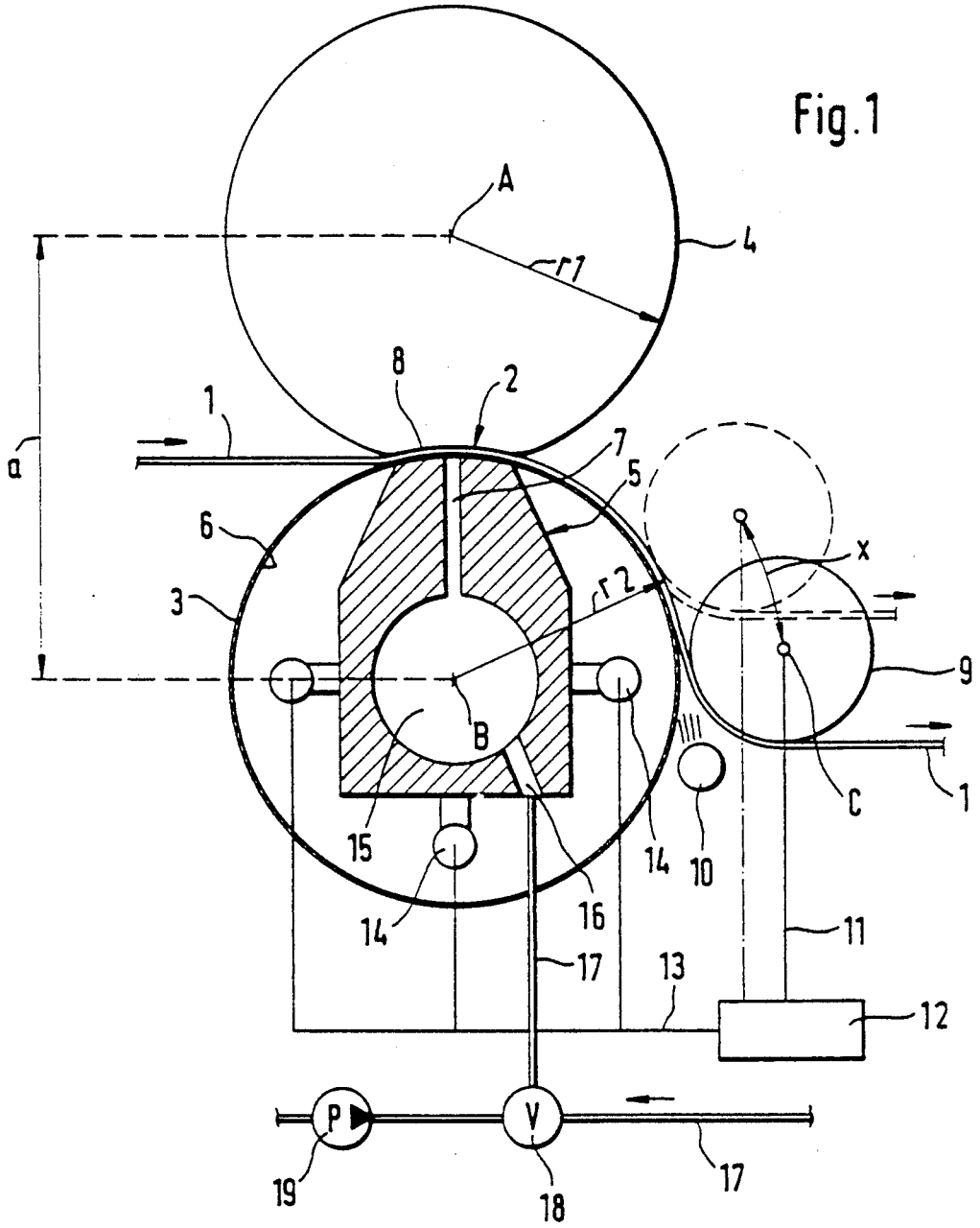
FIG. 1 shows a diagrammatic representation of an apparatus according to the invention for the application of liquid, plastic or pasty substances to a substrate, partially represented as a block circuit diagram, partially in cross-section.

According to FIG. 1, a substrate 1 to be coated runs from a supply roll, not shown in any more detail, into a coating gap 2. This coating gap 2 is formed by a perforated cylinder 3, in particular a metal cylinder, and a counter-pressure roll 4. The counter-pressure roll 4 consists of flexible material. The distance a between the axis of rotation A of the counter-pressure roll 4 and the axis of rotation B of the cylinder 3 is less than the sum of the two radii $r_1$ and $r_2$. As a result, the flexible counter-pressure roll 4 is deformed in the region of the coating gap 2 by the contact pressure of the cylinder 3. This deformation also occurs, of course, whenever, in the narrow sense, without substrate no coating gap is formed between cylinder 3 and roll 4.

In the region of the coating gap 2, from inside the cylinder 3 there presses a coating head 5 against the inside surface 6 of the cylinder 3.

In this case, around an outlet gap 7 of the coating head 5 there is formed a contact surface 8 on both sides of the outlet gap 7, this contact surface having a curvature with approximately the radius $r_{wa}$the inside surface 6. By this arrangement, a region of the coating gap 2 is produced which is sealed off by the contact surface 8 and the counter-pressure roll 4. There is no need, for example, for sealing lips around the outlet gap 7.

After the coating gap 2, the substrate 1 continues to run over a certain distance on the cylinder 3, then lifts off and wraps around a roll 9. According to the invention, the region of the lifting-off of the substrate 1 from the cylinder 3 is irradiated with an infrared light from a corresponding source 10, in order to make an easier liftingoff possible by heating-up of the lifting-off region.

Furthermore, the roll 9 is designed as a compensating roll, i.e. its axis of rotation C can be displaced in direction x. This displacement in direction x, for example into the position for use represented by broken lines, takes place against a counter-holding force, by which it is attempted to move the roll 9 back again into the position for use represented by solid lines. If, for example, the coating applied to the substrate 1 through the outlet gap 7 and through the cylinder 3 is too cold, the adhesion with which the substrate adheres to the cylinder surface increases. The roll 9 yields to this higher adhesion, so that it is displaced in direction x towards the position for use represented by broken lines. This displacement is transferred via a corresponding line 11 to a control unit 12, which emits a control signal via a line 13 or corresponding branch lines to heating elements 14.

In the present illustrative embodiment, the heating elements 14, only represented diagrammatically, are arranged around the coating head 5, but a different assignment of the heating elements 14 is also conceivable. For example, the coating substrate may be heated while on the way to the coating head 5 or heated up once again after running-out of the substrate from the coating gap 2.

If the addition of heat to the coating substrate is increased, the adhesion of the coated substrate 1 on the cylinder 3 is also reduced. Consequently, the force with which the substrate 1 has to be drawn off from the cylinder 3 subsides, so that the roll 9 returns under the corresponding counter force into its position for use, represented by solid lines. This is then again a signal for the control unit 12 to reduce or switch off the addition of heat. This control of the addition of heat requires, however, that the substrate is drawn off from the cylinder 3 with constant tension. Keeping the tension constant is effected by conventional means not represented in any more detail.

Arranged ahead of the outlet gap 7 in the coating head 5 is a main chamber 15, which is in connection with a source, not represented in any more detail, for molten coating material, via corresponding connection channels 16 and supply line 17. According to the invention, a threeway valve 18 is to be inserted into the line 17, via which valve the line 17 can be connected alternately to the coating material source or to a vacuum pump 19.

If, for example, the feed of coating material is to be switched off, a changeover is made by the threeway valve to the vacuum pump 19, via which excess coating material is drawn off from the main chamber 15 or the outlet gap 7.

The vacuum pump can take the form of having a reciprocating piston which together form a working chamber. By retraction of the piston, the working chamber is increased and coating material sucked in. By reversing piston movement, the working chamber is compressed and the coating material is forced out. As a result, a dripping of coating material from the outlet gap 7 is effectively avoided.

Figure 2:
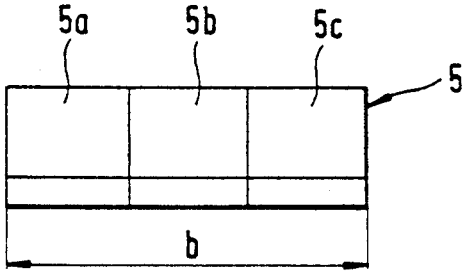
FIG. 2 shows a diagrammatic plan view of a coating head corresponding to FIG. 1.

It is to be regarded as a further improvement of the present invention that the coating head 5, as shown in FIG. 2, is of a multi-part design. In the present illustrative embodiment, the coating head 5 consists of the part-segments 5*a*, 5*b* and 5*c*. These part-segments are connected to one another by means of corresponding tie rods and, if appropriate, sealed off with respect to one another. In this way, the width b of the coating head 5 can be determined and changed. Furthermore, a part-segment, for example 5*b*, may have no outlet gap 7, so that a stripwise coating is performed.

I claim:

1. A process for applying a flowable substance to a substrate comprising heating said substance so that the substance flows, passing the substrate over a perforated cylinder, applying said heated flowable substance to said substrate from a coating head mounted in said cylinder so as to coat same as said substrate passes over said perforated cylinder whereby said substrate maintains contact with said cylinder over a certain distance, lifting off said coated substrate from said cylinder, sensing the adhesion of said substrate to said cylinder and controlling the heating of said substance in response to the sensed adhesion.

2. A process according to claim 1 comprising lifting off said coated substrate by passing said substrate over a lift-off roll which is displaceable in response to the degree of adhesion between said substrate and said cylinder.

3. A process according to claim 2 wherein said heating is controlled in response to the position of said lift-off roll.

4. An apparatus for supplying a flowable substance to a substrate comprising heating means for heating said substance until flowable, a perforated cylinder with a coating head mounted in said cylinder for feeding the flowable substance to said substrate, a counter-pressure roll adjacent said perforated cylinder which defines therewith a coating gap for said substrate, lift-off means downstream of said coating gap for drawing said substrate off said perforated cylinder, sensing means for sensing the adhesion of said substrate to said cylinder and control means for controlling said heating means in response to the second adhesion.

5. An apparatus according to claim 4 wherein said lift-off means comprises a lift-off roll which is displaceably mounted relative to said coating gap in response to the adhesion of said substrate to said cylinder.

6. An apparatus according to claim 4 including an infrared heat source associated with said lift-off means for assisting in drawing said substrate off said cylinder.

7. An apparatus for supplying a flowable substance to a substrate comprising heating means for heating said substance until flowable, a perforated cylinder with a coating heat mounted in said cylinder for feeding the flowable substance to said substrate, said perforated cylinder having a radius and an axis of rotation, a counter-pressure roll adjacent said perforated cylinder which defines therewith a coating gap for said substrate said counter-pressure roll having a radius and an axis of rotation wherein the distance between the axes of rotation of the counter-pressure roll and cylinder is less than the sum of the radii.

8. An apparatus according to claim 7 wherein the counter-pressure roll consists of a flexible material and wherein a contact surface of the coating head has, for the formation of the coating gap, a curvature of which the radius corresponds approximately to that of the cylinder.

9. An apparatus according to claim 4 including pump means for feeding said substance to said cylinder.

10. An apparatus according to claim 4 wherein the coating head is produced from part-segments, via which its width can be determined, and a stripwise coating is possible by part-segments having no outlet gap.

11. An apparatus according to claim 7 wherein lift-off means are provided downstream of said coating gap for drawing said substrate off said perforated cylinder.

* * * * *